US005129155A

United States Patent [19]

Hoffman et al.

[11] Patent Number: 5,129,155

[45] Date of Patent: Jul. 14, 1992

[54] AUTOMATIC SCREEN REGISTRATION DEVICE AND METHOD THEREFOR

[75] Inventors: Richard Hoffman, Chicago; Aleksander Szyszko, Carol Stream, both of Ill.

[73] Assignee: M & R Printing Equipment, Inc., Glen Ellyn, Ill.

[21] Appl. No.: 591,783

[22] Filed: Oct. 2, 1990

[51] Int. Cl.[5] ..... B41F 15/14

[52] U.S. Cl. ..... 33/614; 33/621; 101/115; 101/DIG. 36

[58] Field of Search ..... 33/614, 616, 621, 627; 101/115, DIG. 36

[56] References Cited

U.S. PATENT DOCUMENTS

| | | | |
|---|---|---|---|
| 1,839,866 | 1/1932 | Claybourn | 33/616 |
| 2,689,411 | 9/1954 | Huck | 33/621 |
| 3,943,851 | 3/1976 | Inada et al. | 101/DIG. 36 |
| 4,005,651 | 2/1977 | Sigel et al. | 33/614 |
| 4,099,460 | 7/1978 | Bubley et al. | 101/115 |
| 4,463,673 | 8/1984 | Moore | 33/614 |
| 4,489,652 | 12/1984 | Takeuchi et al. | 101/DIG. 36 |
| 4,907,505 | 3/1990 | Ericsson et al. | 101/DIG. 36 |

FOREIGN PATENT DOCUMENTS

| | | | |
|---|---|---|---|
| 2031341 | 4/1980 | United Kingdom | 101/DIG. 36 |

*Primary Examiner*—Thomas B. Will

*Attorney, Agent, or Firm*—Wallenstein, Wagner & Hattis, Ltd.

[57] ABSTRACT

An automatic screen registration device for a screen having a pair of generally perpendicular intersecting fiducial lines, each of the fiducial lines having first and second edges, the second edge being generally parallel to and to the outside of the first edge, comprising a base plate having a pair of opposing end edges, air cylinders for positioning the screen on the base plate along an adjacent side edge and end edge of the base plate, servo motors for indexing translational movement of the screen on the base plate from the adjacent side and end edges of the base plate, a light source and a light detector for sensing the first edge of each of the intersecting fiducial lines of the screen, a microprocessor for generating a signal upon sensing the first edge of each of the intersecting fiducial lines, and which is responsive to the detection of the first edge for slowing translational movement of the screen, a light source and a light detector for sensing the second edges of each of the intersecting fiducial lines of the screen, and a microprocessor responsive to the detection of the second edge of the fiducial lines for ceasing translational movement of the screen from the adjacent side and end edges of the base plate upon sensing the second edges of each of the intersecting fiducial lines of the screen.

17 Claims, 4 Drawing Sheets

AUTOMATIC SCREEN REGISTRATION DEVICE AND METHOD THEREFOR

TECHNICAL FIELD OF THE INVENTION

The present invention relates generally to the field of screen printing. More specifically, the present invention relates to a device and method for automatically aligning screens in registration.

BACKGROUND OF THE INVENTION

Printed indicia which are applied to T-shirts and other articles of clothing have become very popular in the last decade. Boutiques which specialize in printing fanciful indicia such as ornamentation, slogans, college names, or sports team names on T-shirts and other clothing are commonly seen in shopping malls. The indicia available at these boutiques can be pre-printed on a substrate and applied to articles of clothing purchased by the consumer with a heated press by boutique operators, or can be applied directly to an article of clothing. The indicia can comprise either simple one-color block letters or elaborate multi-color illustrations.

In common use in the industry in printing objects such as substrates or articles of clothing is a multi-station, turret type, printing press. The printing press of this type has a plurality of flat beds or platens spaced along its perimeter. Corresponding to each of these beds is a series of stations where a part of the indicia is alternately printed and cured on the object, i.e., substrate or article, being printed. The number of stations employed depends on the number of colors to be printed on the object. Indicia can consist of up to ten colors or more.

Also in common use are single station printing machines. Single station machines require the operator to print one color at a time using one screen at a time. After one color is printed on an object, the screen is removed and another screen placed thereon to print another color. As with the multi-station press, the new screen must be perfectly aligned with the preceding screen such that the image remains in registration. This single-stage process is very time-consuming, especially if multiple colors are used.

In using either the single or multi-station presses, the indicia or design is formed in the screen by a conventional process. The screen has an emulsion, which covers some of the interstices in the screen, and other places which are open so ink of a particular color may be deposited onto the object to be printed in the pattern defined by the open or uncovered area. For each color, a different stencilled screen is desired with a different pattern.

To print, the stencil screen embodying the indicia is placed over the object. Ink of the type well-known in the industry for making transfers is flooded onto the screen. After the ink is flooded onto the screen, the ink is squeegeed through the screen onto the object leaving ink of the desired color in the pattern defined by the open interstices in the screen. The squeegee is of any type well-known in the art.

After the excess ink is squeegeed from the screen, the ink is then dried or cured onto the object to be printed. Depending on the type of ink used, the ink is either cured on the object by heating it to a critical temperature, or simply by letting it dry if ink containing solvents is used. Heat is commonly applied by an energy source directed toward the object. The above process is repeated for every color to be contained in the indicia.

The most critical and time-consuming part of the screen printing process involving multiple colors is the alignment or registration of successive screens. Each screen for each color must be in registration with the other screens to ensure that the various colors do not overlap or are incorrectly spaced. Otherwise, the printed indicia will not be in registration, resulting in a skewed or imperfect indicia. Presently, screens are aligned in registration manually, requiring a skilled operator to properly align the screens. However, even with a highly skilled operator the set-up time for screens can take fifteen minutes or more. An unskilled operator takes even longer. Manual registration of screens is well-known in the art.

A screen is manually set in registration by lining up fiducial lines etched in the screen itself or on the screen frame with fiducial lines on the object or on the press itself. Use of fiducial lines is well-known in the art. Due to the parallax experienced when an operator views successive screens from different angles, the screens may be out of registration even with a highly skilled operator. Oftentimes, several pieces are printed to determine if each screen is in registration. If the screens are out of registration, the entire screen alignment process must be redone, and any prints made therefrom must be scrapped. This obviously results in increased down time and production costs, and reduced productivity.

SUMMARY OF THE INVENTION

The present invention is an automatic screen registration device for use in screen printing. The screen contains a pair of fiducial lines which may intersect at right angles defining a plane. The fiducial lines have first and second edges. The screen containing the fiducial lines is positioned over a base plate having a pair of opposing side edges and a pair of opposing end edges. The base plate has means for positioning relative to the screen on the base plate along an adjacent side edge and end edge, means for indexing translational movement of the screen on the base plate from the adjacent side and end edges of the base plate, means for sensing the second edge of each of the intersecting fiducial lines of the screen, and means for ceasing translational movement of the screen from the adjacent side and end edges of the base plate when the sensing means senses the second edges of each of the intersecting fiducial lines of the screen.

It is an object of the present invention to provide an apparatus which automatically aligns printing screens on a turret type or single station printer in precise registration. This allows the use of unskilled operators to properly align screens, thereby reducing the cost of manpower, and totally eliminating human error in the alignment of screens. It also significantly reduces the amount of time necessary for alignment of screens, thereby further reducing downtime and increasing productivity. The present invention is also ideal for aligning large screens in registration as it automatically compensates for screen frame deflection.

Other advantages and aspects of the invention will become apparent upon making reference to the specification, claims, and drawings to follow.

DETAILED DESCRIPTION OF THE INVENTION

Figure 1:
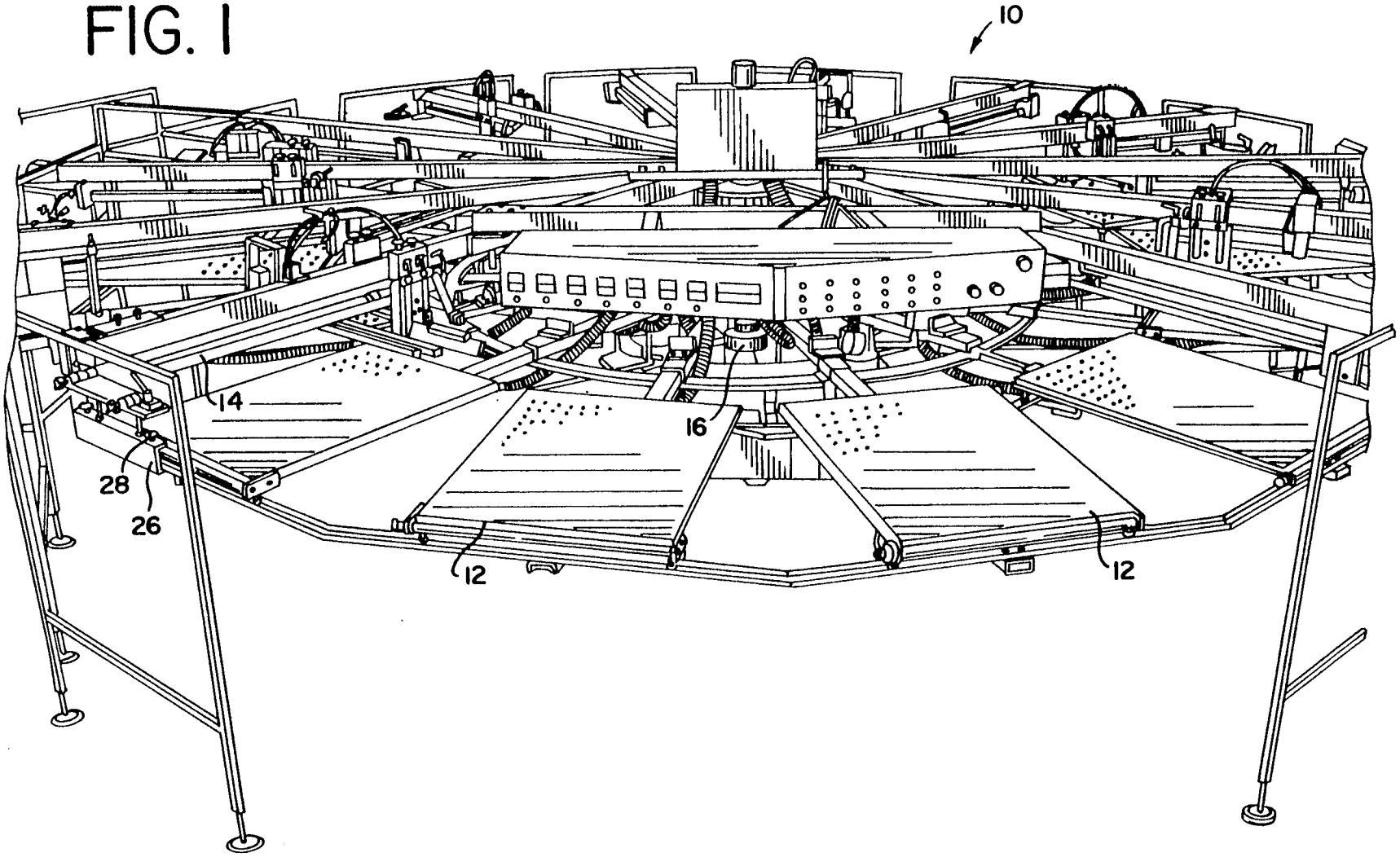
FIG. 1 is a perspective view of a typical multi-station turret printing press.

While this invention is susceptible of embodiment in many different forms, there is shown in the drawings, and will herein be described in detail, a preferred embodiment of the invention, with the understanding that the present disclosure is to be considered as an exemplification of the principles of the invention, and is not intended to limit the broad aspect of the invention to the embodiment illustrated.

Referring now to the drawings, FIG. 1 discloses a typical multi-station printing press 10. While the present invention will be described in connection with the multi-station press, it will be understood that the present invention may also be used to align successive screens in a single station press. The press 10 consists of a series of beds 12 spaced along its perimeter. The beds 12 are typically made of a metal such as aluminum or stainless steel. Corresponding to the beds 12 are a series of print stations 14. The stations 14 are designed to alternately print and cure objects. In the middle of the press 10 is a conventional means 16 to rotate the beds 12 between the stations 14 after each print cycle is completed. The loading area is shown in the foreground of FIG. 1.

Figure 2:
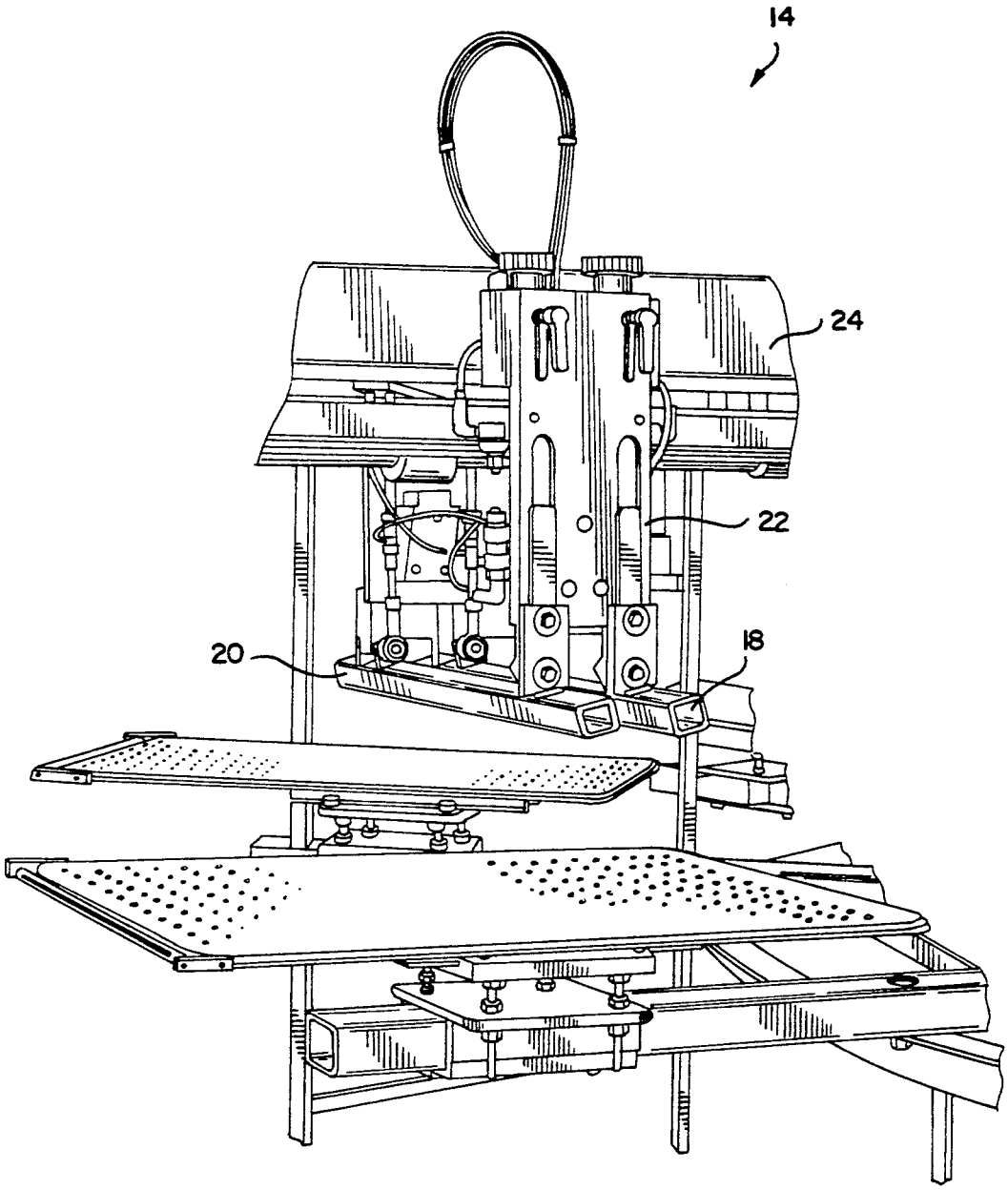
FIG. 2 is a perspective view of a printing station in a typical turret printing press.

FIG. 2 discloses one station 14 of the press 10 designed to print on objects. The station 14 comprise a flood bar 18 and a squeegee 20. The flood bar 18 and squeegee 20 are attached to a housing 22 which slidably engages arm 24. The flood bar 18 and squeegee bar 20 operate to print on an object (not shown) in a conventional manner.

At each print station 14 are a pair of opposing screen holders 26. The screen holders 26 extend beneath the radial arm 24. On each screen holder 26 are a pair of clamps 28, typically air-operated, which hold a screen 30 in place after it is properly aligned using the automatic screen registration device of the present invention in a manner to be described. During the printing operation, the screens 30 remain stationary, while the beds 12 having the object to be printed thereon index from screen to screen to allow different colors of ink to be placed thereon.

The screen 30 is typically made of a polyester or nylon material, and is stretched taut across a frame 32 in a conventional manner. The screen 30 embodies one color component of an indicia to be printed. Each color printed requires a different screen 30. Either etched on the screen 30 or the frame 32 are a pair of intersecting fiducial lines 34. The fiducial lines 34 are used to align successive screens 30 such that the different colors of the indicia are in precise alignment at each printing station. The fiducial lines 34 are typically on the order of 1/16" wide, and are translucent. The fiducial lines 34 have a first and second edges 35 and 37 defined by their width. Each screen 30 has its own set of fiducial lines 34 to allow the screen 30 to be properly aligned. Use of fiducial lines to align screens is well-known.

Figure 3:
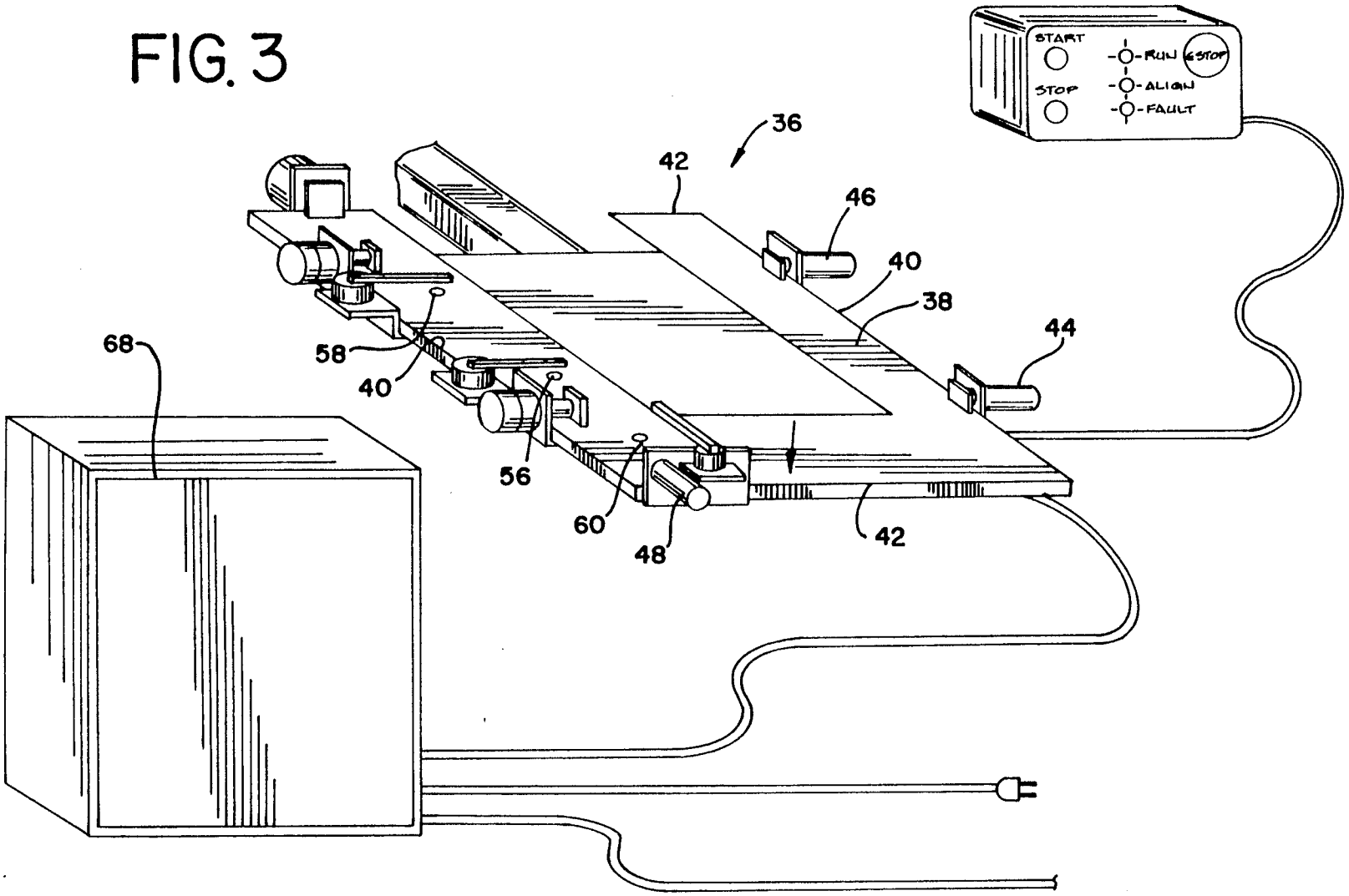
FIG. 3 is a perspective view of the preferred embodiment of the present invention.
Figure 4:
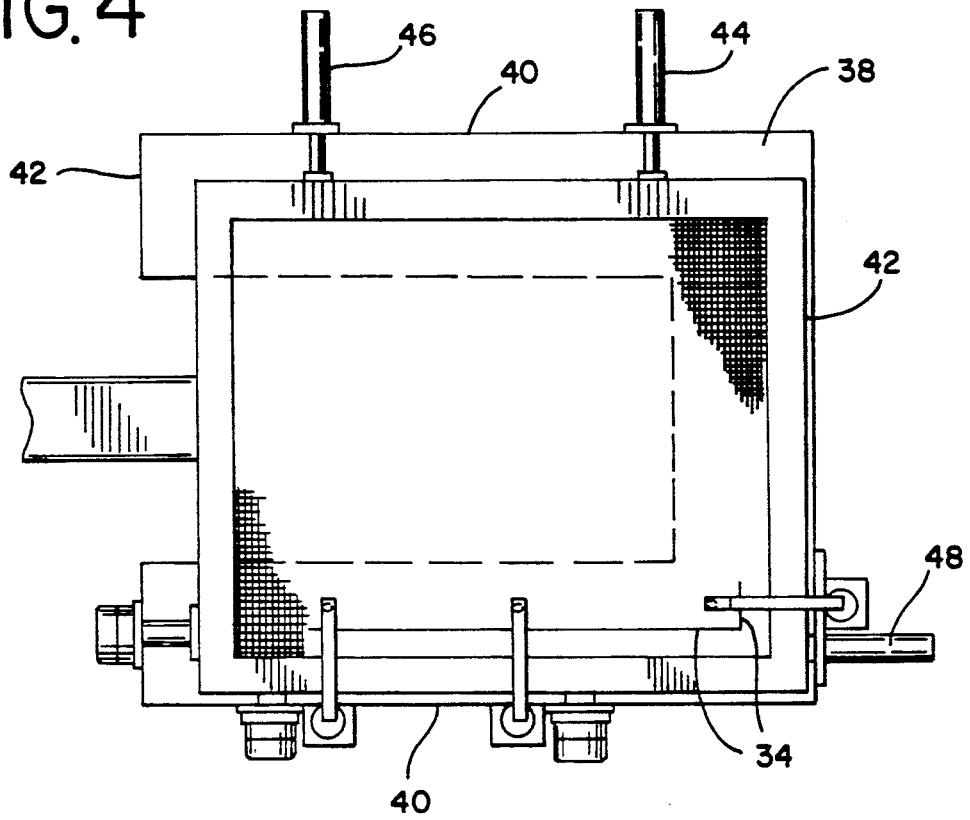
FIG. 4 is a top view of a screen on the base plate of the present invention prior to the screen being aligned in registration.
Figure 5:
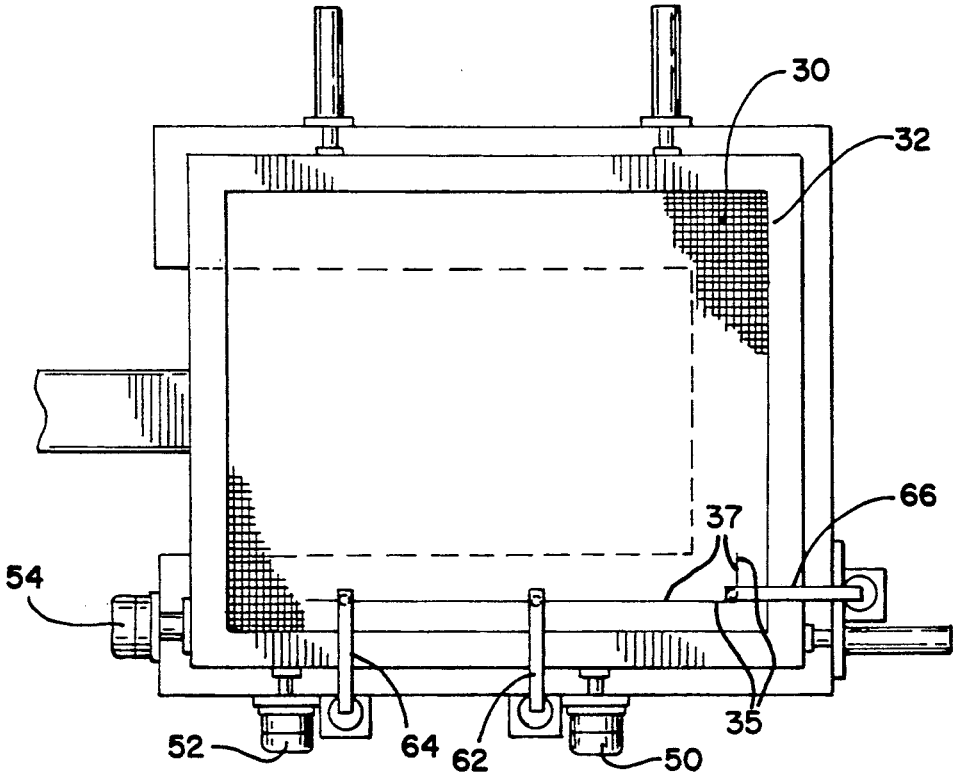
FIG. 5 is a top view of the present invention after the screen is aligned in registration.

FIG. 3 discloses the preferred embodiment of the present invention 36. The present invention 36 comprises a base plate 38 having a pair of side edges 40 and a pair of end edges 42. Located along a side edge 40 are first and second air cylinders 44 and 46. A third air cylinder 48 is located along an end edge 42 of the base plate 38. It will be understood that, alternatively, the first and second air cylinders 44 and 46 may be located on an end edge 42 of the base plate 38, and the third air cylinder 48 may be placed along a side edge 40 of the base plate 38.

Located at opposing side edges 40 and end edges 42 of the base plate 38 opposite the first, second, and third air cylinders 44, 46, and 48, are first, second and third servo motors 50, 52, and 54 respectively. Located near a side edge 40 of the base plate 38 are first and second light sources 56 and 58. The first and second light sources 56 and 58 form a line along one side edge 40 of the base plate 38 generally parallel to the side edge 40. A third light source 60 is positioned at an end edge 42 of the base plate 38. The positioning of the first, second and third light sources 56, 58 and 60 is to allow the fiducial lines 34 to pass over the first, second and third light sources 56, 58 and 60 such that the edges of the fiducial lines 34 are detected by said light sources. Alternatively, the first and second light sources 56 and 58 may be placed along an end edge 42 of the base plate 38 with the third light source 60 along a side edge 40. The first, second and third light sources 56, 58 and 60 form a plane so as to align the screen 30 in a plane.

First, second and third light detectors 62, 64 and 66 are preferably positioned below the screen 30 and a reflective means (not shown) placed along the fiducial lines 34 to reflect light emitted by the light sources 56, 58 and 60 back underneath the screen 30 to prevent possible breaking of the light detectors 62, 64 and 66. The light detectors 62, 64 and 66 may also be positioned above the first second and third light sources 56, 58 and 60 respectively to detect light emitted from the light sources, and passing through the fiducial lines 34.

Each of the servo motors 50, 52 and 54 has a corresponding light detector. Each of the servo motor/light detector pairs are separately controlled by a microprocessor 68. The microprocessor 68 controls the alignment process described below.

The base plate 38 is preferably adapted to removably attach to the bed 12. This allows for the present invention to be both easily placed on the machine to align the screens 30 thereon, and to remove it when all of the screens 30 are in registration.

To register a screen or series of screens 30 using the present invention, the screen 30 is placed between screen holders 26 at the print station 14. The bed 12 having the present invention 36 attached is indexed to the print station 14. The bed 12 is raised to engage the underside of the screen 30 by the base plate 38. The first, second and third air cylinders 44, 46 and 48 then push the screen 30 to the opposing adjacent side edge 40 and end edge 42 of the base plate 3 such that the fiducial lines 34 are past the light sources 56, 58 and 60. The first, second and third servo motors 50, 52 and 54 then slowly push the screen 30 away from the adjacent side edge 40 and end edge 42 back in the direction of the air cylinders.

After the air cylinders 44, 44, and 46 position the screen along the adjacent side edge 40 and end edge 42 of the base plate 38, light is emitted by the light sources 56, 58 and 60. When the light is shining on the opaque screen 30, no light is reflected to the light detectors 62, 64 and 66. However, when the first edge of the fiducial lines 34 pass over the light sources 56, 58 and 60, light is passed through the translucent fiducial lines 34, and reflected to the light detectors 62, 64 and 66. As would be expected, the light detectors do not simultaneously detect the first edge of the fiducial line. Each of the servo/motor detector pairs are separately controlled by the microprocessor 68. As one of the detectors detects light emitted by its corresponding light source, a signal is then sent from that light detector to the microprocessor controller 68. The microprocessor 68 then sends a signal to the corresponding servo motors to slow the translational movement of the screen 30 caused by such motor. As each of the detectors detects emitted light, it triggers a signal to the microprocessor 68 to slow the translational movement of the screen 30 caused by that servo motor.

The translational movement of the screen 30 continues at the reduced rate until the second edge of the fiducial line 34 is detected. As the fiducial line 34 passes over one of the light sources 56, 58 or 60, light is continually reflected to the corresponding light detector 62 64 or 66. Once the fiducial line 34 completely passes over one of the light sources, light is no longer reflected to the corresponding light detector, and a signal is sent to the corresponding servo motor from the microprocessor 68 to cease translational movement of the screen 30. This same process occurs with each of the servo motor/light detector pairs until the screen is aligned by the second edges 37 of the fiducial lines 34. After the screen 30 is aligned using the above process, the clamps 28 are activated, either manually or automatically, to hold the screen 30 in place throughout the printing process.

To index the rest of the screens 30, the bed 12 with the present invention 36 attached is indexed to the other print stations 14, and the above procedure is repeated for each screen 30 in a turret-type machine. In a single-station machine, the used screen must be replaced by a new screen 30 to print a different color, and the new screen 30 must be aligned by repeating the above process. Performing screen alignment with the present invention allow one to reduce the time necessary for screen alignment to approximately three minutes rather than the more than fifteen minutes required by a skilled operator manually aligning the screens or even longer by an unskilled operator, and will insure accuracy.

While specific embodiments have been illustrated and described, numerous modifications come to mind without departing from the spirit of the invention, and the scope of protection is limited only by the scope of the accompanying claims.

We claim:

1. An automatic screen registration device for a screen having a pair of generally perpendicular intersecting fiducial lines, each of said fiducial lines having first and second edges, said second edge being generally parallel to and to the outside of said first edge, comprising:

a base plate having a pair of opposing side edges and a pair of opposing end edges;

means for positioning the screen on said base plate along an adjacent side edge and end edge of said base plate;

means for indexing translational movement of the screen on said base plate from said adjacent side and end edges of said base plate;

means for sensing the first edge of each of the intersecting fiducial lines of the screen;

first means for generating a signal upon sensing said first edge of each of the intersecting fiducial lines;

means responsive to said first signal generating means for slowing translational movement of the screen;

means for sensing the second edge of each of the intersecting fiducial lines of the screen; and, means for ceasing translational movement of the screen from said adjacent side and end edges of said base plate when said sensing means senses the second edge of each of the intersecting fiducial lines of the screen.

2. The automatic screen registration device of claim 1 wherein said positioning means comprises:

first and second air cylinders located along a side edge of said base plate, said first and second air cylinders adapted to push the screen adjacent to the opposing side edge of said base plate; and a third air cylinder located along an end edge of said base plate, said third air cylinder adapted to push the screen adjacent to the opposing end edge of said base plate.

3. The automatic screen registration device of claim 1 wherein said positioning means comprises:

first and second air cylinders located along an end edge of said base plate, said first and second air cylinders adapted to push the screen adjacent to the opposing end edge of said base plate; and a third air cylinder located along a side edge of said base plate, said third air cylinder adapted to push the screen adjacent to the opposing side edge of said base plate.

4. The automatic screen registration device of claim 2 wherein said indexing means comprises:

first and second servo motors located along a side edge of said base plate opposite said first and second air cylinders, said first and second servo motors adapted to index the translational movement of the screen generally toward said side edge of said base plate having said first and second air cylinders; and a third servo motor located along an end edge of said base plate opposite said third air cylinder, said third servo motor adapted to index the translational movement of the screen generally toward said end edge of said base plate having said third air cylinder.

5. The automatic screen registration device of claim 3 wherein said indexing means comprises:

first and second servo motors located along an end edge of said base plate opposite said first and second air cylinders, said first and second servo motors adapted to index the translational movement of the screen generally toward said end edge of said base plate having said first and second air cylinders; and a third servo motor located along a side edge of said base plate opposite said third air cylinder, said third servo motor adapted to index the translational movement of the screen generally toward said side edge of said base plate having said third air cylinder.

6. The automatic screen registration device of claim 1 wherein said sensing means comprises:

first and second light sources located along a side edge of said base plate such that said first and second light sources form a line generally parallel to said side edge;

a third light source located along an end edge of said base plate; and means for detecting light generated by each of said first, second and third light sources.

7. The automatic screen registration device of claim 1 wherein said sensing means comprises:

first and second light sources located along an end edge of said base plate such that said first and second light sources form a line generally parallel to said side edge;

a third light source located along a side edge of said base plate; and means for detecting light generated by each of said first, second and third light sources.

8. The automatic screen registration device of claims 6 or 7 further comprising means for reflecting light generated by said first, second and third light sources such that light emitted by said first, second and third light sources is reflected to said detecting means.

9. The automatic screen registration device of claims 6 or 7 wherein said detecting means comprises a photoelectric eye.

10. The automatic screen registration device of claim 1 wherein said base plate is adapted to removably attach to a bed of a screen printing press.

11. The automatic screen registration device of claim 1 wherein said ceasing means comprises a microprocessor operatively engaged with both said detection means and said indexing means, and programmed to stop translational movement of the screen caused by said indexing means when said sensing means senses the second edge of each of the fiducial lines of the screen.

12. The screen registration device of claim 1 wherein said first means for generating a signal upon sensing said first edge of each of the intersecting fiducial lines comprises a microprocessor operatively engaged with said first edge sensing means, and programmed to generate a signal when said first edge sensing means senses the first edge of each of the fiducial lines of the screen.

13. The screen registration device of claim 1 wherein said means responsive to said first signal generating means for slowing translational movement of the screen comprises a microprocessor operatively engaged with both said first signal generating means and said indexing means, and programmed to slow translational movement of the screen caused by said indexing means when said first edge sensing means senses the first edges of each of the fiducial lines of the screen.

14. A method for aligning a screen having a pair of generating perpendicular intersecting fiducial lines, each of said fiducial lines having first and second edges, said second edge being generally parallel to and to the outside of said first edge, comprising the steps of:

positioning the screen on a base plate along an adjacent side edge and end edge of said base plate;

indexing translational movement of the screen on said base plate from said adjacent side and end edges of said base plate;

sensing the first edge of each of the intersecting fiducial lines of the screen;

generating a signal upon sensing said first edge of each of the intersecting fiducial lines;

slowing translational movement of the screen in response to said signal generation;

sensing the second edge of each of the intersecting fiducial lines of the screen;

ceasing translational movement of the screen from said adjacent side and end edges of said base plate when the second edges of each of the intersecting fiducial lines of the screen are sensed.

15. The method of claim 14 further comprising:

generating a signal upon sensing said second edge of each of the intersecting fiducial lines; and, ceasing translational movement of the screen from said adjacent side and end edges of said base plate responsive to generation of a signal upon sensing the second edges of each of the intersecting fiducial lines of the screen.

16. An automatic screen registration device for a screen having a pair of generally perpendicular intersecting fiducial lines, each of said fiducial lines having first and second edges, said second edge being generally parallel to and to the outside of said first edge, comprising:

a base plate having a pair of opposing side edges and a pair of opposing end edges;

means for positioning the screen on said base plate along an adjacent side edge and end edge of said base plate;

means for indexing translational movement of the screen on said base plate from said adjacent side and end edges of said base plate;

means for sensing the first edge of each of the intersecting fiducial lines of the screen;

first means for generating a signal upon sensing said first edge of each of the intersecting fiducial lines;

means responsive to said first signal generating means for slowing translational movement of the screen;

means for sensing the second edge of each of the intersecting fiducial lines of the screen; and, second means for generating a signal upon sensing said second edge of each of the intersecting fiducial lines; and, means responsive to said second signal generating means for ceasing translational movement of the screen from said adjacent side and end edges of said base plate when said sensing means senses the second edges of each of the intersecting fiducial lines of the screen.

17. The screen registration device of claim 16 wherein said second means for generating a signal upon sensing said second edge of each of the intersecting fiducial lines comprises a microprocessor operatively engaged with said second edge sensing means, and programmed to generate a signal when said second edge sensing means senses the second edges of each of the fiducial lines of the screen.

* * * * *